US011714366B2

(12) United States Patent
Fujishima et al.

(10) Patent No.: US 11,714,366 B2
(45) Date of Patent: Aug. 1, 2023

(54) IMAGE FORMING APPARATUS

(71) Applicant: KYOCERA Document Solutions Inc., Osaka (JP)

(72) Inventors: Masashi Fujishima, Osaka (JP); Norio Kubo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/863,032

(22) Filed: Jul. 12, 2022

(65) Prior Publication Data

US 2023/0039831 A1 Feb. 9, 2023

(30) Foreign Application Priority Data

Jul. 19, 2021 (JP) ..... 2021-118424

(51) Int. Cl.
*G03G 15/095* (2006.01)
*G03G 21/10* (2006.01)

(52) U.S. Cl.
CPC ..... *G03G 15/095* (2013.01); *G03G 21/105* (2013.01)

(58) Field of Classification Search
CPC ..... G03G 21/10–12; G03G 15/08
See application file for complete search history.

(56) References Cited

U.S. PATENT DOCUMENTS 9,880,515 B2 * 1/2018 Nohara ..... G03G 15/0877

FOREIGN PATENT DOCUMENTS

| | | | |
|---|---|---|---|
| JP | 2006119289 A | * | 5/2006 |
| JP | 2013-037257 A | | 2/2013 |
| JP | 2017097158 A | * | 6/2017 |
| JP | 2018091925 A | * | 6/2018 |

* cited by examiner

*Primary Examiner* — Leon W Rhodes, Jr.
(74) *Attorney, Agent, or Firm* — Stein IP, LLC

(57) ABSTRACT

An image forming apparatus includes an image supporter, a development unit, a cleaning unit, a collection unit, and a controller. The collection unit includes a collection path where a developer discharge path for transport of a waste developer from a discharger of the development unit and a toner discharge path for transport of waste toner from the cleaning unit merge with each other, and collects the waste developer including the waste toner and waste carrier. A place of a high flow resistance is formed at least partially at the collection path. If the weight ratio of the waste carrier to the waste toner included in the waste developer in the collection path is less than a predetermined value, the controller performs carrier discharge process of moving the carrier from the development unit to the image supporter and removing and discharging the carrier using the cleaning unit during non-image formation.

7 Claims, 5 Drawing Sheets

IMAGE FORMING APPARATUS

INCORPORATION BY REFERENCE

This application is based on and claims the benefit of priority from Japanese Patent Application No. 2021-118424 filed on Jul. 19, 2021, the contents of which are hereby incorporated by reference.

BACKGROUND

The present disclosure relates to an image forming apparatus.

In an apparatus widely used as an image forming apparatus of an electrophotographic system such as a copier or a printer, toner is attached to an electrostatic latent image formed on a surface of an image supporter such as a photosensitive drum to develop the electrostatic latent image, thereby forming a toner image to be transferred later to a recording medium such as a sheet. In a development unit, to form uniform images continuously, a developer including toner stored in a developer container is transported while being agitated in the developer container.

SUMMARY

An image forming apparatus according to one aspect of the present disclosure includes an image supporter, a development unit, a cleaning unit, a collection unit, and a controller. The image supporter has a surface on which a toner image is supported. The development unit includes a developer container storing a two-component developer including toner and carrier, a developer supporting member on which the developer in the developer container is supported, and a discharger that discharges excess of the developer from the developer container. The development unit forms the toner image by developing an electrostatic latent image formed on the surface of the image supporter with the toner. The cleaning unit removes the toner remaining on the surface of the image supporter. The collection unit includes a collection path for transport where a developer discharge path for transport of a waste developer discharged from the discharger and a toner discharge path for transport of waste toner removed by the cleaning unit merge with each other, and collects the waste developer including the waste toner and waste carrier through the collection path. The controller controls operations of the image supporter, the development unit, the cleaning unit, and the collection unit. A place of a higher flow resistance than a flow resistance in the toner discharge path is formed at least partially at the collection path. If the weight ratio of the waste carrier to the waste toner is less than a predetermined value in the waste developer in the collection path, the controller performs carrier discharge process moving the carrier during non-image formation from the development unit to the surface of the image supporter and removing and discharging the moved carrier from the surface of the image supporter using the cleaning unit.

DETAILED DESCRIPTION

An embodiment of the present disclosure will be described below on the basis of the drawings. The present disclosure is not limited to the content described below.

Figure 1:
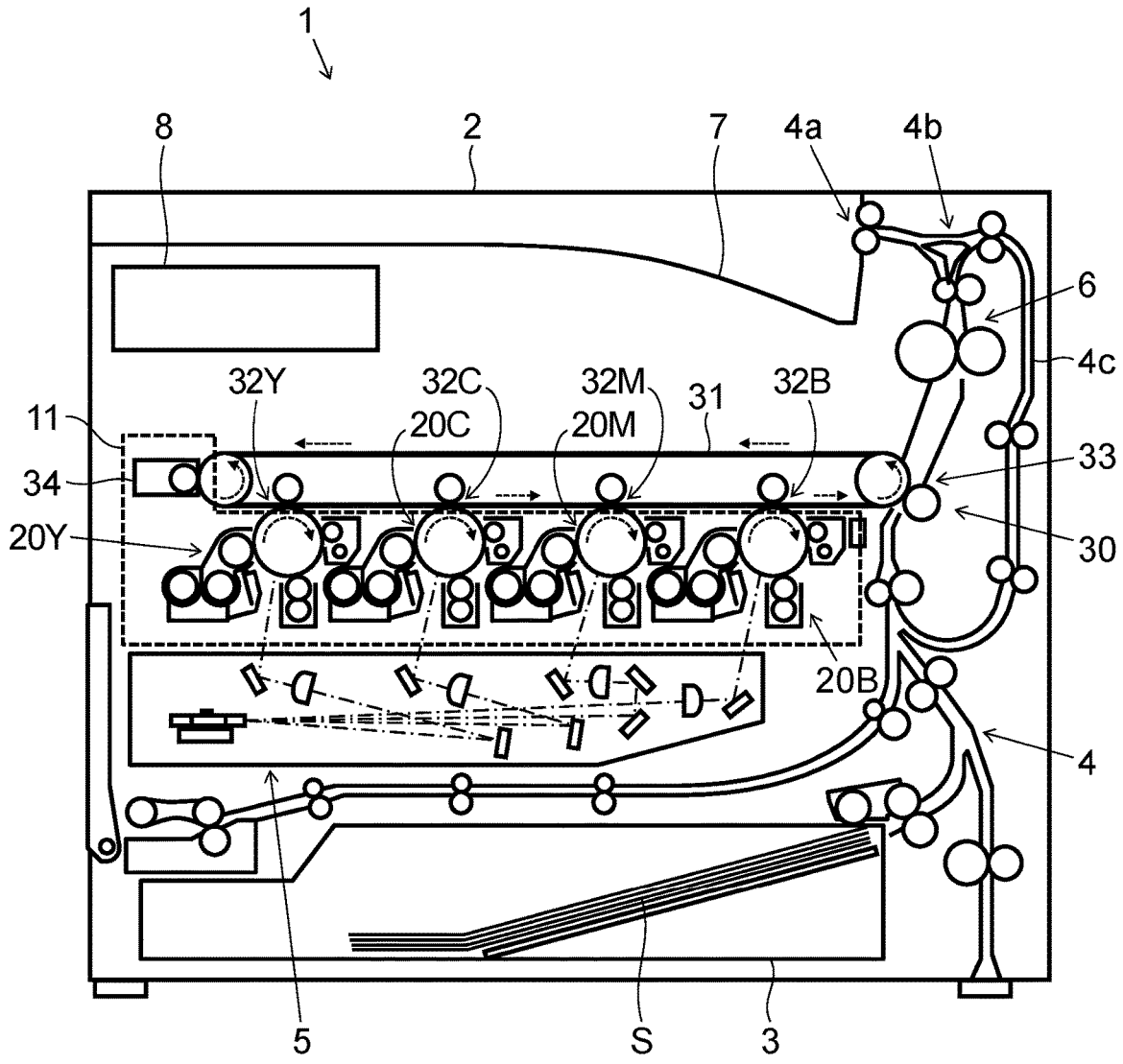
FIG. 1 is a vertical sectional front view schematically showing an image forming apparatus according to an embodiment of the present disclosure.
Figure 2:
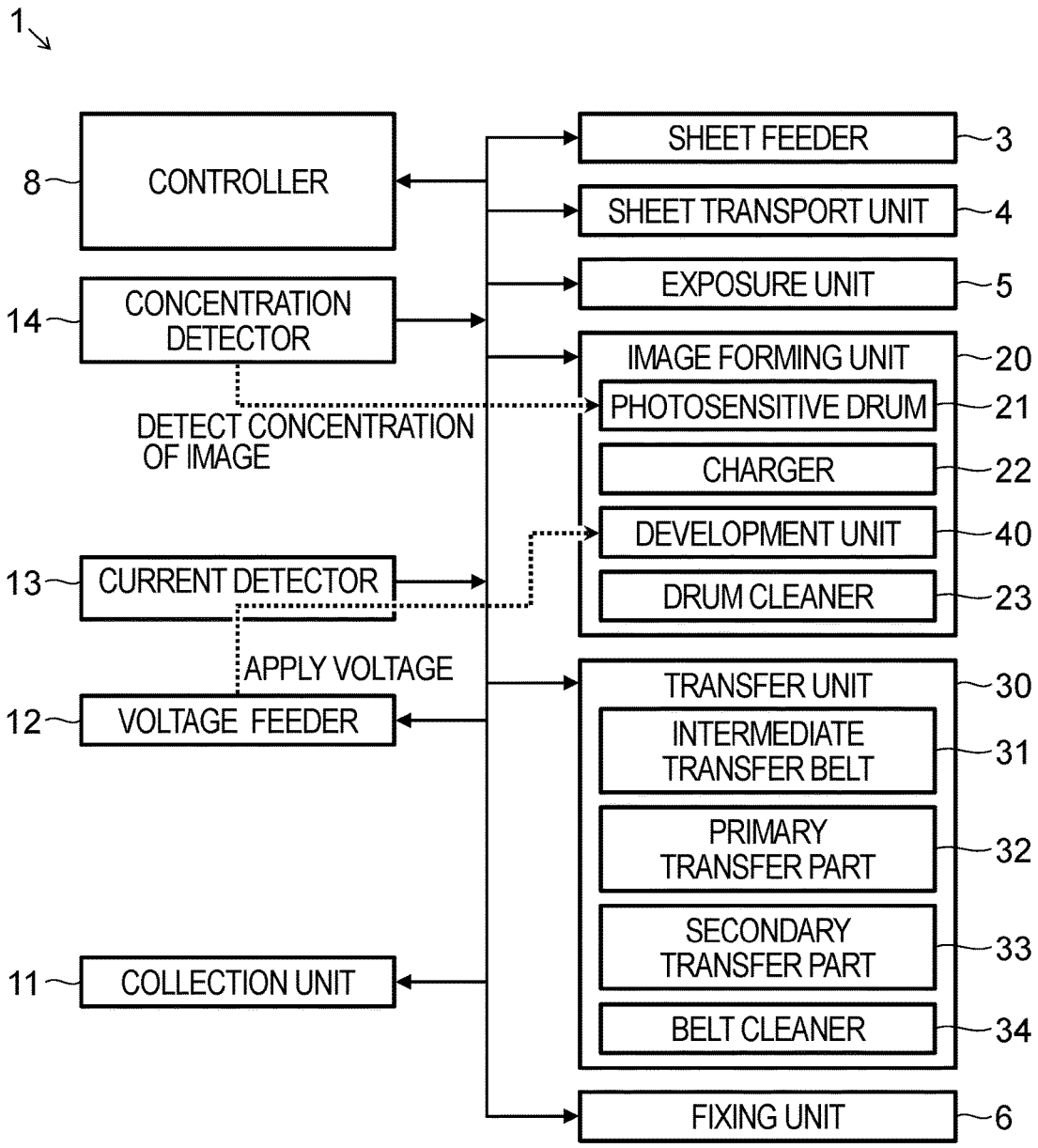
FIG. 2 is a block diagram showing the configuration of the image forming apparatus in FIG. 1.
Figure 3:
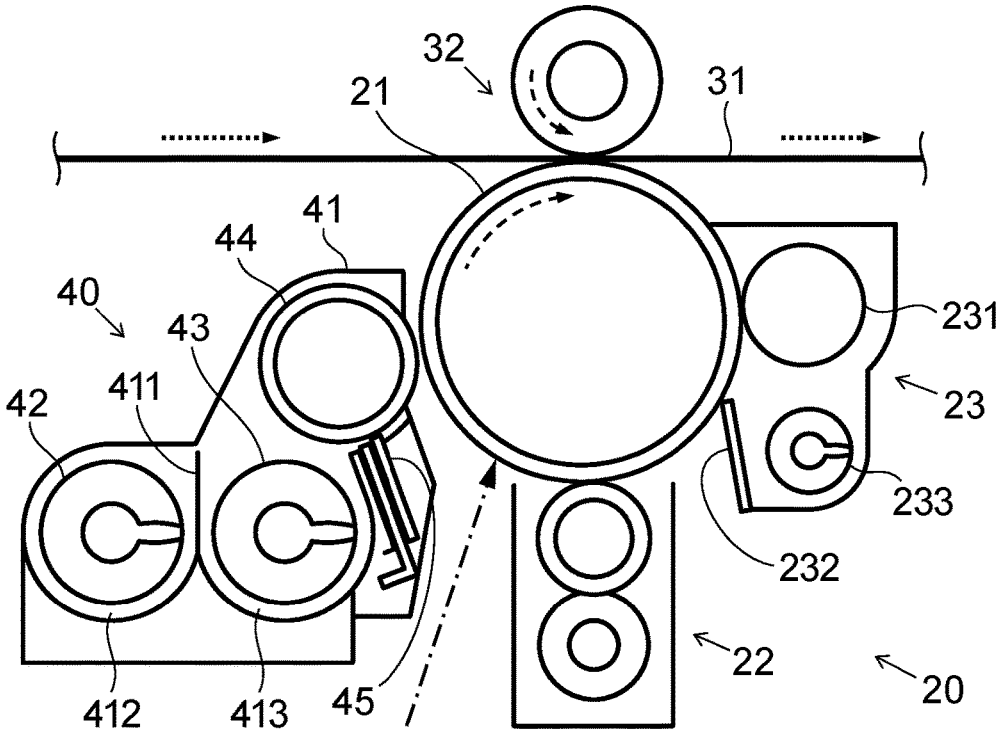
FIG. 3 is a vertical sectional front view schematically showing an image forming unit and its peripherals of the image forming apparatus in FIG. 1.

FIG. 1 is a vertical sectional front view schematically showing an image forming apparatus 1 according to the embodiment. FIG. 2 is a block diagram showing the configuration of the image forming apparatus 1 in FIG. 1. FIG. 3 is a vertical sectional front view schematically showing an image forming unit 20 and its peripherals of the image forming apparatus 1 in FIG. 1. An example of the image forming apparatus 1 according to the present embodiment is a tandem color printer to transfer a toner image to a sheet S using an intermediate transfer belt 31. The image forming apparatus 1 may be what is called a multifunction peripheral with functions such as printing, scanning (image reading), facsimile transmission functions, etc.

As shown in FIGS. 1, 2, and 3, the image forming apparatus 1 includes a sheet feeder 3, a sheet transport unit 4, an exposure unit 5, the image forming unit 20, a transfer unit 30, a fixing unit 6, a sheet ejection unit 7, and a controller 8 provided to a body 2 of the image forming apparatus 1.

The sheet feeder 3 stores a plurality of sheets S and feeds the sheets S separately one by one for printing. The sheet transport unit 4 transports the sheet S fed from the sheet feeder 3 to a secondary transfer part 33 and to the fixing unit 6, and transports the sheet S after being subjected to fixing further to the sheet ejection unit 7 through a sheet ejection port 4*a*. In duplex printing, the sheet transport unit 4 allocates the sheet S to a reverse transport part 4*c* using a branch part 4*b* after the sheet S is subjected to fixing on its first surface, and transports the sheet S again to the secondary transfer part 33 and to the fixing unit 6. The exposure unit 5 emits a laser beam controlled on the basis of image data toward the image forming unit 20.

The image forming unit 20 is arranged below the intermediate transfer belt 31. The image forming unit 20 includes an image forming unit 20Y for yellow, an image forming unit 20C for cyan, an image forming unit 20M for magenta, and an image forming unit 20B for black. These four image forming units 20 have the same basic configuration. For this reason, the identification marks "Y," "C," "M," and "B" representing the corresponding colors may be omitted from the following description except for the case where these colors should particularly be defined.

The image forming unit 20 includes a photosensitive drum (image supporter) 21 supported in such a manner as to be rotatable in a predetermined direction (clockwise direction in FIGS. 1 and 3). The image forming unit 20 further includes a charger 22, a development unit 40, and a drum cleaner 23 arranged around the photosensitive drum 21 and in a direction in which the photosensitive drum 21 rotates. A primary transfer part 32 is arranged between the development unit 40 and the drum cleaner 23.

The photosensitive drum 21 has a photosensitive surface on its outer peripheral surface. The charger 22 charges a surface of the photosensitive drum 21 to a predetermined potential. The exposure unit 5 exposes the surface of the photosensitive drum 21 charged by the charger 22 to light to form an electrostatic latent image of a document image. The development unit 40 develops the electrostatic latent image by supplying toner to this image, thereby forming a toner image. By doing so, the toner image is supported on the surface of the photosensitive drum 21. Each of the four images forming units 20 form toner images of respective colors. After a toner image is primarily transferred to a surface of the intermediate transfer belt 31, the drum cleaner 23 cleans the photosensitive drum 21 by removing toner, etc. remaining on the surface of the photosensitive drum 21. In this way, the image forming unit 20 forms an image on the sheet S.

As shown in FIG. 1, the transfer unit 30 includes the intermediate transfer belt (image supporter) 31, primary transfer parts 32Y, 32C, 32M, and 32B, the secondary transfer part 33, and a belt cleaner 34. The intermediate transfer belt 31 is arranged over the four image forming units 20. The intermediate transfer belt 31 is supported in such a manner as to be rotatable in a predetermined direction (anticlockwise direction in FIG. 1). The intermediate transfer belt 31 is an intermediate transfer member on which toner images supported on the surfaces of the respective photosensitive drums 21 of the four image forming units 20 are superimposed sequentially on each other and primarily transferred. The four image forming units 20 are arranged in what is called tandem arrangement by which the four image forming units 20 are placed side by side in a line from an upstream side toward a downstream side of the direction of rotation of the intermediate transfer belt 31.

The primary transfer parts 32Y, 32C, 32M, and 32B are arranged over the image forming units 20Y, 20C, 20M, and 20B respectively of the corresponding colors across the intermediate transfer belt 31. The secondary transfer part 33 is arranged on the upstream side of a sheet transport direction from the fixing unit 6 relative to the sheet transport unit 4 and on the downstream side of the direction of rotation of the intermediate transfer belt 31 from the image forming units 20Y, 20C, 20M, and 20B of the corresponding colors relative to the transfer unit 30. The belt cleaner 34 is arranged on the upstream side of the direction of rotation of the intermediate transfer belt 31 from the image forming units 20Y, 20C, 20M, and 20B of the corresponding colors.

A toner image is primarily transferred to the surface of the intermediate transfer belt 31 at each of the primary transfer parts 32Y, 32C, 32M, and 32B of the corresponding colors. Then, together with the rotation of the intermediate transfer belt 31, the toner images at the four image forming units 20 are superimposed on each other and transferred to the intermediate transfer belt 31 continuously at predetermined times. By doing so, the toner images of the four colors including yellow, cyan, magenta, and black are superimposed on each other to form a color toner image on the surface of the intermediate transfer belt 31.

The color toner image on the surface of the intermediate transfer belt 31 is transferred at a secondary transfer nip part formed at the secondary transfer part 33 to the sheet S having been transported by the sheet transport unit 4 in synchronization with the color toner image. The belt cleaner 34 cleans the intermediate transfer belt 31 by removing toner, etc. remaining on the surface of the intermediate transfer belt 31 after the secondary transfer.

The fixing unit 6 is arranged above the secondary transfer part 33. The fixing unit 6 applies heat and pressure to the sheet S with the transferred toner image, thereby fixing the toner image on the sheet S.

The sheet ejection unit 7 is arranged above the transfer unit 30. After the toner image is fixed on the sheet S and printing is finished, the sheet S is transported to the sheet ejection unit 7.

The controller 8 includes a CPU, an image processor, a storage, and other electronic circuits and electronic components (none of which are shown in the drawings). The CPU controls the operation of each constituting element provided in the image forming apparatus 1 to perform processing relating to the function of the image forming apparatus 1 on the basis of a control program and control data stored in the storage. Each of the sheet feeder 3, the sheet transport unit 4, the exposure unit 5, the image forming unit 20, the transfer unit 30, and the fixing unit 6 receives a command individually from the controller 8 to achieve printing on the sheet S in a coordinated manner. The storage is composed of a combination of a nonvolatile storage device such as a program read-only memory (ROM) or a data ROM, and a volatile storage device such as a random access memory (RAM), for example.

Figure 4:
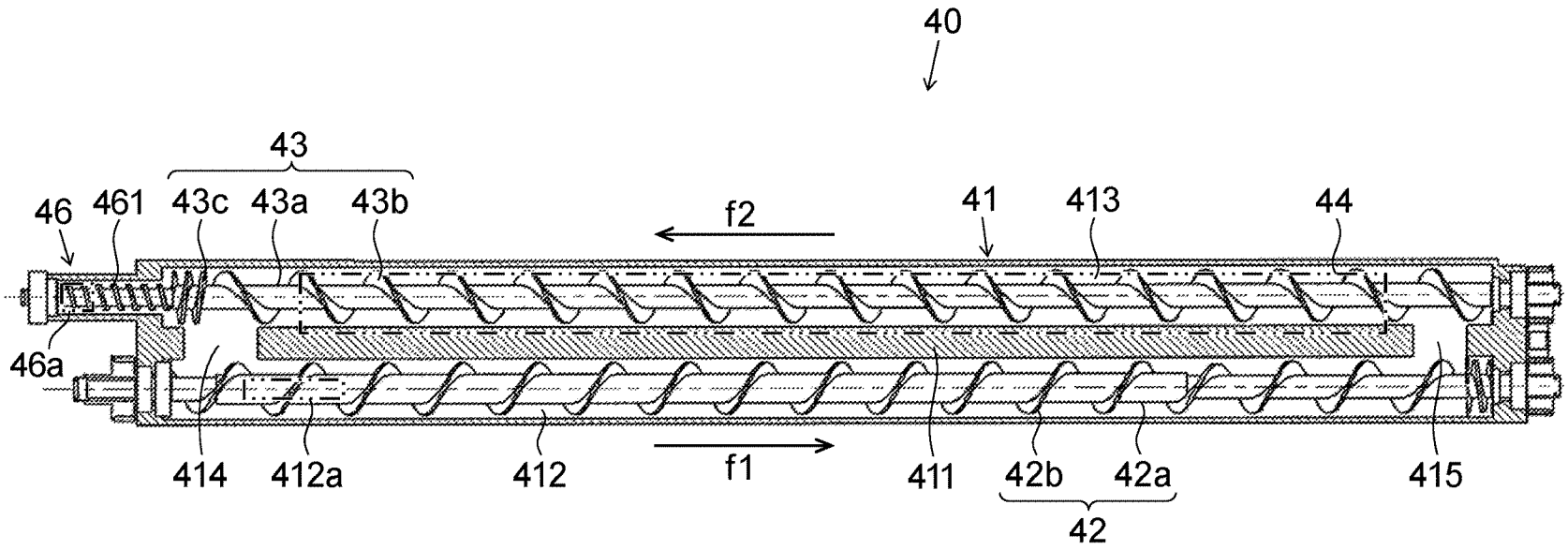
FIG. 4 is a horizontal sectional plan view showing a development unit of the image forming unit in FIG. 3.
Figure 5:
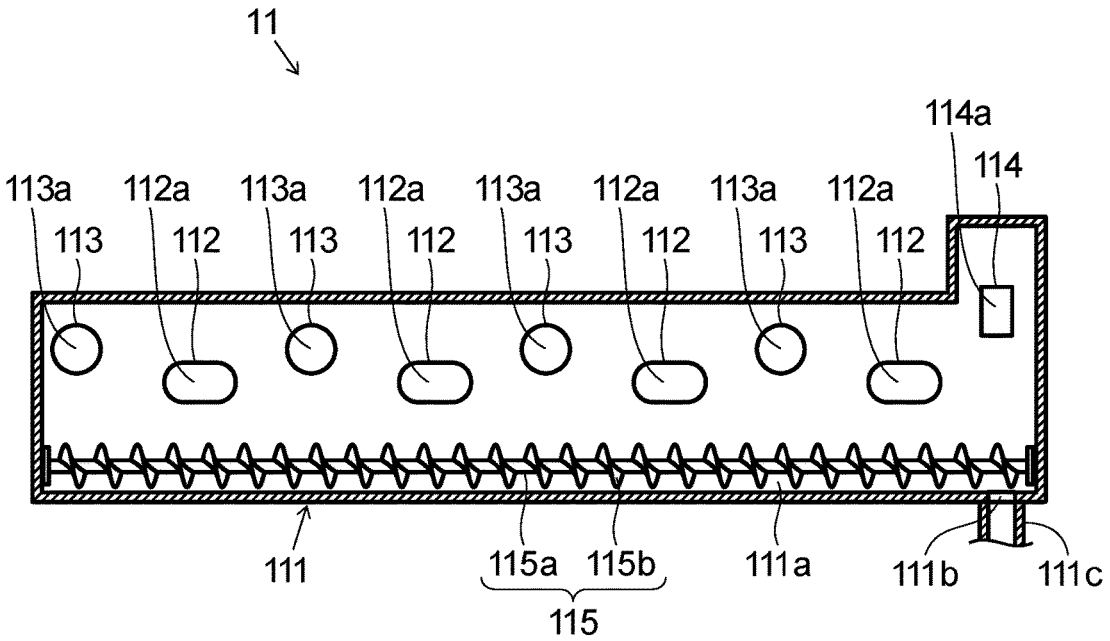
FIG. 5 is a vertical sectional back view schematically showing a collection unit of the image forming apparatus in FIG. 1.

The configuration of the image forming unit 20 and those of its peripherals will be described next using FIGS. 4 and 5 in addition to FIGS. 2 and 3. FIG. 4 is a horizontal sectional plan view showing the development unit 40 of the image forming unit 20 in FIG. 3. FIG. 5 is a vertical sectional back view schematically showing a collection unit 11 of the image forming apparatus 1 in FIG. 1.

The development unit 40 supplies toner to the surface of the photosensitive drum 21. The development unit 40 includes a developer container 41, a first transport member 42, a second transport member 43, a developing roller (developer supporting member) 44, a regulation blade 45, and a discharger 46.

The developer container 41 has an elongated shape extending in a direction of an axis of the photosensitive drum 21 (a direction along the depth of the plane of FIG. 3) and is arranged in such a manner that the length thereof extends in a horizontal direction. The developer container 41 stores a two-component developer including toner and magnetic carrier, for example, as a developer to be supplied to the photosensitive drum 21.

The developer container 41 includes a partition 411, a first transport chamber 412, a second transport chamber 413, a first communication part 414, and a second communication part 415.

The partition 411 is provided at a lower position inside the developer container 41. The partition 411 is arranged at a substantially central position as viewed in a direction (a right-left transverse direction in FIG. 3 and a top-bottom direction in FIG. 4) crossing the lengthwise direction of the developer container 41. The partition 411 is formed into a substantially plate-like shape extending in the lengthwise direction and in the top-bottom direction of the developer container 41. The partition 411 separates the interior of the developer container 41 in the direction crossing the lengthwise direction.

The first transport chamber 412 and the second transport chamber 413 are provided inside the developer container 41. The first transport chamber 412 and the second transport chamber 413 are formed by separating the interior of the developer container 41 using the partition 411 and are arranged side by side to heights substantially equal to each other.

The second transport chamber 413 is arranged below and adjacent to an arrangement region of the developing roller 44 in the developer container 41. Specifically, the second transport chamber 413 faces the developing roller 44. The first transport chamber 412 is arranged in a region farther from the developing roller 44 than the second transport chamber 413 in the developer container 41. The first transport chamber 412 has an opened developer refilling port 412*a* and the developer is refilled through the developer refilling port 412*a*.

The first communication part 414 and the second communication part 415 are arranged external to corresponding opposite ends of the partition 411 as viewed in its lengthwise direction. The first communication part 414 and the second communication part 415 form communication between the first transport chamber 412 and the second transport chamber 413 in the direction (the right-left transverse direction in FIG. 3 and the top-bottom direction in FIG. 4) crossing the lengthwise direction of the partition 411, specifically, in a thickness direction of the partition 411 having a substantially plate-like shape. In other words, the first transport chamber 412 and the second transport chamber 413 communicate with each other at the opposite ends as viewed in the lengthwise direction.

The first transport member 42 is arranged in the first transport chamber 412. The second transport member 43 is arranged in the second transport chamber 413. The second transport member 43 extends close to and parallel to the developing roller 44. The first transport member 42 and the second transport member 43 are each supported in the developer container 41 in such a manner as to be rotatable about an axis extending in the horizontal direction parallel to the developing roller 44. The first transport member 42 and the second transport member 43 have the same basic configuration. The first transport member 42 includes a first transport blade 42*b* of a spiral shape provided on an outer periphery of a rotary shaft 42*a* extending in the lengthwise direction of the developer container 41. The second transport member 43 includes a second transport blade 43*b* of a spiral shape provided on an outer periphery of a rotary shaft 43*a* extending in the lengthwise direction of the developer container 41.

The first transport member 42 transports the developer while agitating the developer in the first transport chamber 412 in a first direction f1 from the first communication part 414 side toward the second communication part 415 side along a direction of the axis of rotation. The second transport member 43 transports the developer while agitating the developer in the second transport chamber 413 in a second direction f2 from the second communication part 415 side toward the first communication part 414 side along a direction of the axis of rotation. The second direction f2 is opposite to the first direction f1.

The first communication part 414 permits communication between a downstream end of the second transport chamber 413 as viewed in the second direction f2 and an upstream end of the first transport chamber 412 as viewed in the first direction f1. In the first communication part 414, the developer is transported from the second transport chamber 413 side toward the first transport chamber 412 side. The second communication part 415 permits communication between a downstream end of the first transport chamber 412 as viewed in the first direction f1 and an upstream end of the second transport chamber 413 as viewed in the second direction f2. In the second communication part 415, the developer is transported from the first transport chamber 412 side toward the second transport chamber 413 side.

The developing roller 44 is arranged above the second transport chamber 413 in the developer container 41. The developing roller 44 is arranged in such a manner as to be exposed from the developer container 41 at a part of a surface of the developing roller 44 and to face the photosensitive drum 21. The developing roller 44 is supported in the developer container 41 in such a manner as to be rotatable about an axis extending parallel to the axis of the photosensitive drum 21. The developing roller 44 supports the developer in the second transport chamber 413. The developing roller 44 supplies the toner in the developer container 41 to the surface of the photosensitive drum 21 in a region in which the developing roller 44 faces the photosensitive drum 21 to develop an electrostatic latent image, thereby forming a toner image.

The regulation blade 45 is arranged upstream of a direction of rotation of the developing roller 44 from the region in which the developing roller 44 and the photosensitive drum 21 face each other. The regulation blade 45 is close to and faces the developing roller 44, and is arranged with a predetermined interval between a tip of the regulation blade 45 and the surface of the developing roller 44. The regulation blade 45 extends over an entire region of the developing roller 44 as viewed in a direction of an axis of the developing roller 44. The regulation blade 45 regulates the thickness of the developer (toner) supported on the surface of the developing roller 44 during passage through the interval between the tip of the regulation blade 45 and the surface of the developing roller 44.

In response to rotations of the first transport member 42 and the second transport member 43, the developer in the developer container 41 circulates in a predetermined circulation direction between the first transport chamber 412 and the second transport chamber 413 while passing through the first communication part 414 and the second communication part 415. At this time, the toner in the developer container 41 is agitated, charged, and supported on the surface of the developing roller 44. The toner on the surface of the developing roller 44 has its thickness regulated by the regulation blade 45, and is thereafter transported by the rotation of the developing roller 44 to the region in which the developing roller 44 and the photosensitive drum 21 face each other. When a prescribed developing voltage is applied to the developing roller 44, a potential difference is generated from a potential at the surface of the photosensitive drum 21 to move the toner supported on the surface of the developing roller 44 to the surface of the photosensitive drum 21 in the region in which the developing roller 44 and the photosensitive drum 21 face each other. By doing so, an electrostatic latent image on the surface of the photosensitive drum 21 is developed with the toner.

The discharger 46 is provided further downstream from the downstream end of the second transport chamber 413 as viewed in the second direction f2. The discharger 46 connects to the second transport chamber 413. The interior of the discharger 46 and that of the second transport chamber 413 communicate with each other. The discharger 46 includes a developer outlet 46*a* and a discharge blade 461.

The rotary shaft 43*a* of the second transport member 43 extends continuously into the discharger 46. One end of the rotary shaft 43*a* as viewed in a direction of its axis is rotatably supported in the developer container 41 at a downstream end of the discharger 46 as viewed in the second direction f2 of the second transport chamber 413.

The developer outlet 46*a* is located at the downstream end of the discharger 46 as viewed in the second direction f2 of the second transport chamber 413. The developer outlet 46*a* is opened below the rotary shaft 43*a* of the second transport member 43, for example. Excess of the developer in the developer container 41 is discharged through the developer outlet 46*a*. Specifically, excess of the developer in the second transport chamber 413 is transported toward the developer outlet 46*a* in the discharger 46.

The discharge blade 461 extends in a spiral pattern at an outer periphery of the rotary shaft 43*a* of the second transport member 43 in the direction of its axis. Like the second transport blade 43*b*, the discharge blade 461 is provided integrally with the rotary shaft 43*a*. The discharge blade 461 is wound in the same direction as the second transport blade 43*b*. Specifically, a direction in which the developer is transported in the discharger 46 is the same as the second direction f2 of the second transport chamber 413. By doing so, excess of the developer in the discharger 46 is transported with the discharge blade 461 toward the developer outlet 46*a*. For example, the discharge blade 461 has a smaller pitch and a lower outer diameter than the second transport blade 43*b*.

The second transport member 43 includes a regulator 43*c* in addition to the second transport blade 43*b*. Like the second transport blade 43*b*, the regulator 43*c* is provided integrally with the rotary shaft 43*a*.

The regulator 43*c* is arranged downstream of the second direction f2 of the second transport chamber 413 from the second transport blade 43*b* of the second transport member 43. The regulator 43*c* faces a connection between the second transport chamber 413 and the discharger 46 as viewed in the direction of the axis of the rotary shaft 43*a*.

The regulator 43*c* is formed into a blade shape extending in a spiral pattern at the outer periphery of the rotary shaft 43*a* in the direction of its axis. Specifically, the regulator 43*c* is formed on the second transport member 43 in the second transport chamber 413. The regulator 43*c* is wound in the opposite direction from the second transport blade 43*b*. By doing so, the regulator 43*c* stops the developer having been transported to the vicinity of the downstream end in the second transport chamber 413 to limit movement of the developer toward the discharger 46. The regulator 43*c* has a smaller pitch than the second transport blade 43*b*.

The regulator 43*c* has an outer periphery arranged at a predetermined gap (clearance) from the inner surface of the developer container 41. When the developer reaches a predetermined amount or more in the second transport chamber 413, the developer is transported as excess of the developer toward the discharger 46 through the gap between the outer periphery of the regulator 43*c* and the inner surface of the developer container 41.

The drum cleaner 23 removes the toner remaining on the surface of the photosensitive drum 21 after primary transfer. The drum cleaner 23 includes a cleaning roller 231, a cleaning blade 232, and a discharge member 233.

The cleaning roller 231 contacts the surface of the photosensitive drum 21 under a predetermined pressure and is driven by a driver (not shown in the drawings) to rotate in a direction in which a region of the contact with the photosensitive drum 21 moves in the same direction as the photosensitive drum 21. The cleaning blade 232 contacts the surface of the photosensitive drum 21 under a predetermined pressure. The cleaning roller 231 and the cleaning blade 232 clean the photosensitive drum 21 by removing toner, etc. remaining on the surface of the photosensitive drum 21 after primary transfer. The discharge member 233 has a spiral blade and is used for discharging waste toner having been removed from the surface of the photosensitive drum 21 toward the collection unit 11 described later provided external to the drum cleaner 23.

The belt cleaner 34 has the same configuration as the drum cleaner 23. The belt cleaner 34 removes toner remaining on the surface of the intermediate transfer belt 31 after secondary transfer, and discharges the toner toward the collection unit 11 described later provided external to the belt cleaner 34.

As shown in FIGS. 1, 2, and 5, the image forming apparatus 1 further includes the collection unit 11. The collection unit 11 is arranged on the front side or on the back side of the image forming unit 20 and the transfer unit 30, for example. The collection unit 11 includes a housing 111, a developer discharge pipe 112, a first toner discharge pipe 113, a second toner discharge pipe 114, and a collection member 115.

The housing 111 has an elongated shape extending in a direction in which the four image forming units 20 are arranged side by side (right-left transverse direction in FIG. 1) and the top-bottom direction. The housing 111 has an upper section to which the developer discharge pipe 112, the first toner discharge pipe 113, and the second toner discharge pipe 114 are connected to permit communication with these pipes. The housing 111 stores a waste developer discharged from the discharger 46 of the development unit 40, and waste toner removed by the drum cleaner 23 and the belt cleaner 34.

The collection unit 11 includes four developer discharge pipes 112 extending individually from the dischargers 46 of the corresponding four development units 40. The collection unit 11 includes four first toner discharge pipes 113 extending individually from the corresponding four drum cleaners 23. The second toner discharge pipe 114 extends from the belt cleaner 34. Specifically, the collection unit 11 includes a developer discharge path 112*a* for transport of a waste developer from the development unit 40, a first toner discharge path 113*a* for transport of waste toner from the drum cleaner 23, and a second toner discharge path 114*a* for transport of waste toner from the belt cleaner 34.

The housing 111 has a bottom where a collection path 111*a* is provided. The developer discharge path 112*a*, the first toner discharge path 113*a*, and the second toner discharge path 114*a* merge with each other at the collection path 111*a*. The collection path 111*a* extends in the direction in which the four image forming units 20 are arranged side by side. A waste developer outlet 111*b* opened downward is provided at one end of the bottom of the housing 111 as viewed in the direction in which the collection path 111*a* extends.

The collection member 115 is arranged at the bottom in the housing 111 and over the collection path 111*a*. The collection member 115 is supported in the housing 111 in such a manner as to be rotatable about an axis extending in the direction in which the four image forming units 20 are arranged side by side. The collection member 115 includes a collection blade 115*b* of a spiral pattern provided at an outer periphery of a rotary shaft 115*a* extending in a direction along the length of the housing 111. The collection member 115 transports a waste developer and waste toner having dropped on the collection path 111*a* at the bottom in the housing 111 toward the waste developer outlet 111*b*.

The connection pipe 111*c* is fitted to a lower side of the waste developer outlet 111*b*. A waste tank (not shown in the drawings) is connected to the lower end of the connection pipe 111*c*. The collection path 111*a* includes the waste developer outlet 111*b* and the connection pipe 111*c*. The waste developer outlet 111*b* and the connection pipe 111*c* each have a higher flow resistance than a flow resistance in each of the first toner discharge path 113*a* and the second toner discharge path 114*a* for reason of a smaller flow path diameter or being bent, for example. Specifically, a place of a higher flow resistance than a flow resistance in the toner discharge path is formed at least partially at the collection path 111*a*.

With the above-described configuration, the collection unit 11 collects a waste developer including waste toner and waste carrier through the collection path 111*a*. The image forming apparatus 1 includes the photosensitive drum 21 and the intermediate transfer belt 31 as an image supporter, and includes the drum cleaner 23 and the belt cleaner 34 as a cleaning unit. The collection unit 11 includes the developer discharge path 112*a*, the first toner discharge path 113*a*, the second toner discharge path 114*a*, and the collection path 111*a*. As a result, a waste developer including waste toner and waste carrier can easily be collected together.

The operations of the photosensitive drum 21, the development unit 40, the drum cleaner 23, the belt cleaner 34, and the collection unit 11 are controlled by the controller 8.

The waste developer in the collection path 111*a* was evaluated in terms of a relationship between the weight ratio of waste carrier to waste toner and the occurrence of toner clogging in the waste developer outlet 111*b* or in the connection pipe 111*c* on the collection path 111*a*. Results of the evaluation are shown in Table 1.

TABLE 1

| | Waste developer [g] | Waste toner [g] | Waste carrier [g] | Waste carrier/Waste toner [%] | Toner clogging |
|---|---|---|---|---|---|
| 1 Yellow | 0.5065 | 0.4706 | 0.0359 | 7.63 | No |
| 2 Cyan | 0.5052 | 0.4890 | 0.0162 | 3.31 | Yes |
| 3 Magenta | 0.5030 | 0.4790 | 0.0240 | 5.01 | No |
| 4 Black | 0.5045 | 0.4806 | 0.0239 | 4.97 | No |
| 5 Yellow | 0.5071 | 0.4706 | 0.0365 | 7.76 | No |
| 6 Cyan | 0.5080 | 0.4750 | 0.0330 | 6.95 | No |
| 7 Magenta | 0.5033 | 0.4830 | 0.0203 | 4.20 | Yes |
| 8 Black | 0.5060 | 0.4900 | 0.0160 | 3.27 | Yes |

Table 1 shows evaluation results about a waste developer in the collection path 111*a* from two samples of the waste developer of each of the colors including yellow, cyan, magenta, and black in terms of a relationship between the weight ratio of waste carrier to waste toner and the occurrence of toner clogging in the waste developer outlet 111*b* or in the connection pipe 111*c* on the collection path 111*a*. The weight of the waste toner and that of the waste carrier in the waste developer were calculated by measuring the weight of the waste developer (including the waste toner and the waste carrier) and then measuring the weight of the waste carrier obtained by sucking the waste developer using 795 Mesh.

As understood from Table 1, there is no toner clogging on the collection path 111*a* if the weight ratio of the waste carrier to the waste toner is equal to or greater than 5% in the waste developer in the collection path 111*a*. Thus, if the weight ratio of the waste carrier to the waste toner is less than a predetermined value in the waste developer in the collection path 111*a*, the controller 8 of the image forming apparatus 1 according to the present embodiment performs carrier discharge process of moving carrier from the development unit 40 to the surface of the photosensitive drum 21 and removing and discharging the moved carrier from the surface of the photosensitive drum 21 using the drum cleaner 23 during non-image formation.

In the above-described configuration, discharging the carrier through the photosensitive drum 21 and the drum cleaner 23 achieves an increase in the weight ratio of the waste carrier to the waste toner in the waste developer in the collection path 111*a*, making it possible to maintain the flowability of the waste developer favorably. As a result, the waste developer can be transported smoothly in the collection path 111*a* to allow reduction in the occurrence of toner clogging on the collection path 111*a*.

In particular, on the basis of the evaluation results shown in Table 1, the controller 8 of the image forming apparatus 1 according to the present embodiment performs the carrier discharge process if the weight ratio of the waste carrier to the waste toner is less than 5% in the waste developer in the collection path 111*a*. This configuration allows the carrier discharge process to be performed at appropriate time. Specifically, this can prevent the carrier discharge process from being performed more than necessary, making it possible to encourage increase in productivity in image formation and reduction in consumption of the developer.

The carrier is moved from the development unit 40 to the surface of the photosensitive drum 21 effectively by the following methods, for example. (1) A method of reducing a carrier resistance by increasing a developing current flowing between the developing roller 44 and the photosensitive drum 21. (2) A method of increasing a potential difference between the photosensitive drum 21 and the development unit 40 from sheet to sheet.

The carrier discharge process may be performed by moving carrier from the development unit 40 to the surface of the photosensitive drum 21, moving the carrier further to the surface of the intermediate transfer belt 31, and removing and discharging the moved carrier from the surface of the intermediate transfer belt 31 using the belt cleaner 34.

Conditions for execution of the carrier discharge process will be described next. In this description, the conditions for the configuration and operation of the image forming apparatus 1 are defined as follows. Magnetic carrier in a container (not shown in the drawings) for refilling the developer container 41 with the developer has a filling factor of 10%. A toner consumption per A4 size sheet at a coverage rate of 1% is 3 mg. A transfer efficiency is 80%. An initial developer amount in the developer container 41 is 300 g. A developer amount in the developer container 41 during stability time is 350 g. A toner charged amount during the stability time is 30 μC/g.

With a stable developer amount, the amount of carrier discharged from the discharger 46 of the development unit 40 is the same as the amount of carrier refilled from the container. If a coverage rate is 5%, for example, a toner consumption per A4 size sheet is 15 mg (3 mg×5%). Thus, the amount of toner refilled from the container is also 15 mg. As a carrier filling factor in the container is 10%, a waste carrier amount is 1.5 mg.

A waste toner amount is the amount of toner remaining on the surface of the photosensitive drum 21 and on the surface of the intermediate transfer belt 31 without having been transferred. With a transfer efficiency of 80%, the waste toner amount is 3 mg relative to toner of 15 mg consumed per A4 size sheet.

Thus, the weight ratio of the waste carrier to the waste toner in the waste developer in the collection path 111*a* is determined to be 50% (1.5 mg/3 mg). Table 1 shows that, under this condition, execution of the carrier discharge process is considered to be omissible as the risk of toner clogging on the collection path 111*a* is low.

The weight ratio of the waste carrier to the waste toner becomes less than the predetermined value in the waste developer in the collection path 111*a* when the absence of discharge of the developer (carrier) from the developer container 41 lasts for a long duration. The long duration of the absence of discharge of the developer (carrier) from the developer container 41 occurs in the following cases, for example. (1) During time from start of use of the image forming apparatus 1 to stabilization of a developer amount. (2) In a case where a toner charged amount in the developer container 41 is less than a predetermined value.

In both of these cases, the developer in the developer container 41 falls below a volume at which the developer is stable, so that carrier is not discharged from the developer container 41 as a result of the mechanism. Thus, in these cases, the occurrence of toner clogging on the collection path 111*a* is required to be reduced by discharging carrier forcedly through the photosensitive drum 21 and the drum cleaner 23 and increasing the flowability of a waste developer.

In response to this, during time from start of use of the image forming apparatus 1 to stabilization of a developer amount, for example, the controller 8 performs the carrier discharge process with every predetermined period after the start of use of the image forming apparatus 1. During the time to stabilization of a developer amount, a carrier amount refilled into the developer container 41 is calculated based on a toner amount calculated from a cumulative coverage rate, and carrier of a smaller amount than the amount of the refilled carrier is discharged at right time through the photosensitive drum 21 and the drum cleaner 23. By doing so, the occurrence of toner clogging on the collection path 111*a* can be reduced.

With a toner consumption per sheet of 3 mg at a coverage rate of 1%, for example, carrier of 1.5 mg per sheet is refilled into the developer container 41 if a coverage rate is 5%. Thus, by discharging carrier of equal to or greater than 0.15 mg and less than 1.5 mg per sheet through the photosensitive drum 21 and the drum cleaner 23, the occurrence of toner clogging on the collection path 111*a* can be reduced. This makes it possible to prevent the occurrence of a situation where, during time from start of use of the image forming apparatus 1 to stabilization of a developer amount, the absence of discharge of the developer (carrier) from the developer container 41 lasts for a long duration. Furthermore, the weight ratio of waste carrier to waste toner in a waste developer in the collection path 111*a* can be increased, making it possible to maintain the flowability of the waste developer favorably.

As another example, in response to a case where a toner charged amount in the developer container 41 is less than the predetermined value, the controller 8 measures a toner charged amount in the developer container 41, and performs the carrier discharge process if the measured toner charged amount is less than the predetermined value.

As shown in FIG. 2, for measurement of a toner charged amount, the image forming apparatus 1 further includes a voltage feeder 12, a current detector 13, and a concentration detector 14.

The voltage feeder 12 includes a power source and a control circuit (neither is shown in the drawings), for example. The voltage feeder 12 is electrically connected to the developing roller 44 of the development unit 40. The voltage feeder 12 applies a developing voltage to the developing roller 44. More specifically, the voltage feeder 12 applies a developing voltage including a DC voltage and an AC voltage superimposed on each other to the developing roller 44 during development. The controller 8 controls timing of application, a voltage value, polarity, a duration of the application, etc. for the developing voltage to be applied to the developing roller 44 through the voltage feeder 12.

The current detector 13 detects a developing current flowing between the developing roller 44 and the photosensitive drum 21 when the developing voltage is applied to the developing roller 44. The controller 8 receives information about the amount of the current flowing in the developing roller 44 detected by the current detector 13. A developing current i detected by the current detector 13 is integrated with respect to the duration of application during development, thereby obtaining a total charge amount Q of a developed toner image. The controller 8 can measure the total charge amount Q of the toner image on the basis of the developing current i detected by the current detector 13.

The concentration detector 14 is arranged in such a manner as to face the surface of the photosensitive drum 21. The concentration detector 14 includes a reflective optical sensor including a light emitter with a light emitting element such as a light emitting diode (LED), for example, and a light receiver with a light receiving element such as a photodiode, for example (both of these elements are not shown in the drawings). The light emitter applies detection light at a predetermined angle toward a toner image transferred to the surface of the photosensitive drum 21. The light receiver receives the detection light emitted by the light emitter toward the toner image and reflected on the toner image.

The light receiver includes a regularly reflected light receiver that receives regularly reflected light of the detection light reflected on the toner image, and a diffusely reflected light receiver that receives diffusely reflected light of this detection light. In the absence of toner on the surface of the photosensitive drum 21, the detection light emitted from the light emitter is regularly reflected without being diffusely reflected with toner, and mostly enters the regularly reflected light receiver. As the amount of toner on the surface of the photosensitive drum 21 increases, a larger amount of light is diffusely reflected with the toner to gradually increase the amount of light entering the diffusely reflected light receiver. In this way, the concentration detector 14 emits detection light from the light emitter toward a toner image, and detects the concentration of the toner image formed on the surface of the photosensitive drum 21 on the basis of the detection light reflected on the toner image and received by the light receiver (regularly reflected light receiver and diffusely reflected light receiver).

The concentration detector 14 may be configured to face the surface of the intermediate transfer belt 31 and to detect the concentration of a toner image primarily transferred to the surface of the intermediate transfer belt 31.

A toner weight M of a toner image formed on the surface of the photosensitive drum 21 can be estimated by causing the concentration detector 14 to detect the concentration of the toner image and converting the detected concentration to a weight. As an example, the controller 8 can measure the toner weight M of a toner image formed on the surface of the photosensitive drum 21 on the basis of the concentration of this toner image detected by the concentration detector 14 by using a predetermined table or the like showing a relationship between an output value of the concentration detector 14 and the toner weight M stored in advance in a storage, for example.

The controller 8 can measure a toner charged amount Q/M in the developer container 41 on the basis of the total charge amount Q and the toner weight M of the toner image.

If a toner charged amount in the developer container 41 is less than the predetermined value, specifically, if the toner charged amount in the developer container 41 falls below a toner charged amount during stability time, it becomes difficult to discharge carrier from the developer container 41. If a toner charged amount during stability time is 30 μC/g as described above and if a toner charged amount in the developer container 41 falls below 30 μC/g, for example, it becomes difficult to discharge carrier from the developer container 41.

In response to this, if a toner consumption per sheet is 3 mg at a coverage rate of 1%, for example, discharging carrier of equal to or greater than 0.15 mg and less than 1.5 mg per sheet through the photosensitive drum 21 and the drum cleaner 23 at a coverage rate of 5% achieves reduction in the occurrence of toner clogging on the collection path 111*a*. This makes it possible to prevent the occurrence of a situation where, with a toner charged amount in the developer container 41 of less than the predetermined value, the absence of discharge of the developer (carrier) from the developer container 41 lasts for a long duration. Furthermore, the weight ratio of waste carrier to waste toner in a waste developer in the collection path 111*a* can be increased, making it possible to maintain the flowability of the waste developer favorably.

Using the current detector 13 and the concentration detector 14 like in the above-described case makes it possible to easily measure a toner charged amount in the developer container 41.

For execution of the above-described carrier discharge process, the developer preferably has a carrier current value from 8 to 80 μA. This configuration provides the developer used by the development unit 40 for forming a toner image with a characteristic of being lower in carrier resistance than a developer generally used in an image forming apparatus. This allows carrier to move easily to the photosensitive drum 21. Thus, the carrier can be discharged efficiently through the photosensitive drum 21 and the drum cleaner 23. Specifically, the weight ratio of waste carrier to waste toner in a waste developer in the collection path 111*a* can be increased, making it possible to maintain the flowability of the waste developer favorably.

While the embodiment of the present disclosure has been described above, the scope of the present disclosure is not limited to this but can be changed in various ways and then can be carried out within a range not deviating from the purport of the disclosure.

For example, the image forming apparatus 1 of the above-described embodiment is what is called a tandem image forming apparatus for color printing that forms images of respective colors and superimpose the images sequentially. However, the image forming apparatus is not limited to this type but may be an image forming apparatus for color printing or an image forming apparatus for monochrome printing not employing a tandem form, or may be an image forming apparatus not using an intermediate transfer belt.

What is claimed is:

1. An image forming apparatus comprising:

an image supporter with a surface on which a toner image is supported;

a development unit including a developer container storing a two-component developer including toner and carrier, a developer supporting member on which the developer stored in the developer container is supported, and a discharger that discharges excess of the developer from the developer container, the development unit forming the toner image by developing an electrostatic latent image formed on the surface of the image supporter with the toner;

a cleaning unit that removes the toner remaining on the surface of the image supporter;

a collection unit including a collection path for transport where a developer discharge path for transport of a waste developer discharged from the discharger and a toner discharge path for transport of waste toner removed by the cleaning unit merge with each other, the collection unit collecting the waste developer including the waste toner and waste carrier through the collection path; and a controller that controls operations of the image supporter, the development unit, the cleaning unit, and the collection unit, wherein a place of a higher flow resistance than a flow resistance in the toner discharge path is formed at least partially at the collection path, and if the weight ratio of the waste carrier to the waste toner included in the waste developer in the collection path is less than a predetermined value, the controller performs carrier discharge process of moving the carrier from the development unit to the surface of the image supporter and removing and discharging the moved carrier from the surface of the image supporter using the cleaning unit during non-image formation.

2. The image forming apparatus according to claim 1, wherein the controller measures a toner charged amount in the developer container, and performs the carrier discharge process if the measured toner charged amount is less than a predetermined value.

3. The image forming apparatus according to claim 2, comprising:

a current detector that detects a developing current flowing between the developer supporting member and the image supporter when a developing voltage is applied to the developer supporting member; and a concentration detector that detects the concentration of the toner image formed on the surface of the image supporter, wherein the controller measures a total charge amount of the toner image on the basis of the developing current detected by the current detector, measures a toner weight of the toner image on the basis of the concentration of the toner image detected by the concentration detector, and measures the toner charged amount on the basis of the total charge amount and the toner weight of the toner image.

4. The image forming apparatus according to claim 1, wherein the controller performs the carrier discharge process every predetermined period after the start of use of the image forming apparatus.

5. The image forming apparatus according to claim 1, wherein the controller performs the carrier discharge process if the weight ratio of the waste carrier to the waste toner included in the waste developer in the collection path is less than 5%.

6. The image forming apparatus according to claim 1, wherein the developer has a carrier current value from 8 to 80 μA.

7. The image forming apparatus according to claim 1, wherein the image supporter includes:

a photosensitive drum with a surface on which the toner image formed by the development unit is supported; and an intermediate transfer belt to which the toner image supported on the photosensitive drum is primarily transferred, the cleaning unit includes:

a drum cleaner that removes the toner remaining on the surface of the photosensitive drum; and a belt cleaner that removes the toner remaining on a surface of the intermediate transfer belt, and the collection unit includes:

the developer discharge path for transport of the waste developer extending from the discharger of the development unit;

a first toner discharge path for transport of the waste toner extending from the drum cleaner;

a second toner discharge path for transport of the waste toner extending from the belt cleaner; and the collection path where the developer discharge path, the first toner discharge path, and the second toner discharge path merge with each other.

* * * * *